US007765984B2

(12) United States Patent
Fuerst et al.

(10) Patent No.: US 7,765,984 B2
(45) Date of Patent: Aug. 3, 2010

(54) FUEL INJECTION VALVE

(75) Inventors: Thomas Fuerst, Mentone (AU); Thilo Bolz, Kraichtal (DE); Martin Riemer, Untergruppenbach (DE); Ingo Rettig, Schwieberdingen (DE); Goekhan Guengoer, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/885,599

(22) PCT Filed: Mar. 2, 2006

(86) PCT No.: PCT/EP2006/060398

§ 371 (c)(1),
(2), (4) Date: Apr. 3, 2008

(87) PCT Pub. No.: WO2006/092427

PCT Pub. Date: Sep. 8, 2006

(65) Prior Publication Data

US 2008/0302336 A1 Dec. 11, 2008

(30) Foreign Application Priority Data

Mar. 3, 2005 (DE) ..... 10 2005 009 740
May 2, 2005 (DE) ..... 10 2005 020 380

(51) Int. Cl.
*F02M 55/02* (2006.01)
*F02M 61/14* (2006.01)

(52) U.S. Cl. ..... 123/456; 123/468; 123/470

(58) Field of Classification Search ..... 123/456, 123/468, 469, 470
See application file for complete search history.

(56) References Cited

U.S. PATENT DOCUMENTS 4,294,215 A 10/1981 Hans et al.

(Continued)

FOREIGN PATENT DOCUMENTS

DE 101 08 193 8/2002

(Continued)

OTHER PUBLICATIONS

International Search Report, PCT International Patent Application No. PCT/EP2006/060398, dated Apr. 28, 2006.

(Continued)

*Primary Examiner*—Thomas N Moulis
(74) *Attorney, Agent, or Firm*—Kenyon & Kenyon LLP

(57) ABSTRACT

The fuel injection device according to the present invention is distinguished by a particularly effective sound-decoupling construction. The fuel injection device has at least one fuel injection valve, a receptacle bore for the fuel injection valve in a cylinder head, and a fuel distributor line having a fitting in which the fuel injection valve is placed in partially overlapping fashion. A connecting element is situated in the receptacle bore in such a way that the fuel injection valve is held in the connecting element in such a way that the fuel injection valve and the connecting element are held so that they do not contact any surfaces or walls of the receptacle bore of the cylinder head that do not run axially parallel to the fuel injection valve. The connecting element is attached immediately on the fitting of the fuel distributor line. The fuel injection valve is particularly well-suited for use in fuel injection systems of mixture-compressing externally ignited internal combustion engines.

33 Claims, 17 Drawing Sheets

U.S. PATENT DOCUMENTS

| | | | | |
|---|---|---|---|---|
| 4,307,693 | A | 12/1981 | Gloeckler et al. | |
| 5,074,269 | A * | 12/1991 | Herbon et al. | 123/470 |
| 5,630,400 | A * | 5/1997 | Sumida et al. | 123/470 |
| 5,970,953 | A * | 10/1999 | Lorraine et al. | 123/470 |
| 6,148,797 | A * | 11/2000 | Gmelin | 123/456 |
| 6,199,538 | B1 * | 3/2001 | Aota et al. | 123/470 |
| 6,318,341 | B1 * | 11/2001 | Gmelin et al. | 123/470 |
| 6,467,457 | B1 * | 10/2002 | Lei et al. | 123/456 |
| 6,543,421 | B2 * | 4/2003 | Lorraine et al. | 123/470 |
| 6,640,784 | B1 * | 11/2003 | Sims, Jr. | 123/470 |
| 6,651,628 | B2 * | 11/2003 | Nally | 123/470 |
| 6,684,861 | B2 * | 2/2004 | Reiter | 123/470 |
| 6,718,949 | B2 * | 4/2004 | Gmelin | 123/470 |
| 6,895,939 | B2 * | 5/2005 | Gould et al. | 123/470 |
| 6,953,162 | B2 * | 10/2005 | Hans | 239/585.1 |
| 7,104,257 | B2 * | 9/2006 | Kawamoto et al. | 123/470 |
| 7,213,578 | B2 * | 5/2007 | Oguma | 123/470 |
| 7,334,571 | B1 * | 2/2008 | Beardmore | 123/470 |
| 7,373,926 | B2 * | 5/2008 | Eckbauer et al. | 123/470 |
| 7,406,946 | B1 * | 8/2008 | Watanabe et al. | 123/470 |
| 2003/0154961 | A1 * | 8/2003 | Liskow | 123/470 |
| 2004/0089270 | A1 * | 5/2004 | Scheffel | 123/470 |
| 2005/0278917 | A1 * | 12/2005 | Klann | 29/214 |

FOREIGN PATENT DOCUMENTS

| | | |
|---|---|---|
| EP | 1 278 956 | 1/2003 |
| JP | 55117087 | 9/1980 |
| JP | 56012051 | 2/1981 |
| JP | 59 147863 | 8/1984 |
| JP | 2000-9000 | 1/2000 |
| JP | 2002 39034 | 2/2002 |
| JP | 2002 357170 | 12/2002 |
| JP | 2003 227442 | 8/2003 |
| JP | 2004 245168 | 9/2004 |
| JP | 2004-245169 | 9/2004 |
| JP | 2004 354168 | 12/2004 |
| JP | 2005 500473 | 1/2005 |

OTHER PUBLICATIONS

Written Opinion of the International Searching Authority, PCT International Patent Application No. PCT/EP2006/060398, dated Apr. 28, 2006 (English-language translation provided).
Patent Abstracts of Japan, vol. 2000, No. 04, Aug. 31, 2000.
Patent Abstracts of Japan, vol. 2003, No. 12, Dec. 5, 2003.

* cited by examiner

FUEL INJECTION VALVE

FIELD OF THE INVENTION

The present invention relates to a fuel injection device.

BACKGROUND INFORMATION

German Published Patent Application No. 101 08 193 describes a fastening device for the mutual fastening of a fuel injection valve in a cylinder head of an internal combustion engine, and of the fuel injection valve to a fuel distributor line. The fastening device includes a sleeve that is clamped between a shoulder of the fuel distributor line and a shoulder of the fuel injection valve and is made of an elastic material. Due to its tube-shaped structure, the sleeve can transmit the hold-down forces to the fuel injection valve with only limited effectiveness. The surfaces of the sleeve acting as a hold-down device that are loaded by the shoulders of the fuel injection valve and of the fuel distributor line represent the cutting edges that result from the manner in which the blank for the sleeve is manufactured. The fuel injection valve is placed into a receptacle bore of the cylinder head, and is supported against a supporting ring that lies against a radial shoulder of the receptacle bore. The support ring is fashioned so as to be rounded towards the fuel injection valve, and acts as a bearing point of the fuel injection valve in the receptacle bore of the cylinder head. The support ring can be made of an elastic material, and effects a centering and a slight compensatory movement of the fuel injection valve in the receptacle bore. The tilting movement enables a radial tolerance compensation between the fuel injection valve and the fuel distributor line. The sleeve is clamped in place via an additional clamping of the fuel distributor line on the cylinder head by screws. This creates a spring force that acts on the fuel injection valve and holds this valve against the combustion pressure.

This design has the result that, by the hold-down force and also by the high fuel pressure present inside the fuel distributor line, the fuel injection valve is pressed into the cylinder head via the support ring in such a way that an undesirably high degree of solidborne sound transmission takes place from the fuel injection valve into the cylinder head, which can be clearly audible in a negative manner.

SUMMARY

The fuel injection device according to example embodiments of the present invention provides that the solidborne transmission of sound from the fuel injection valve into the cylinder head is significantly reduced. According to example embodiments of the present invention, this is achieved in that the fuel injection valve is connected directly to the fuel distributor line via a connecting element, but is largely decoupled from the receptacle bore of the cylinder head. The fuel injection valve is situated in the receptacle bore of the cylinder head such that it is mounted without contacting any surfaces or walls of the receptacle bore that do not extend axially parallel to the fuel injection valve.

The connecting body may provide a tilting movement of the fuel injection valve in order to provide radial tolerance compensation between the cylinder head and the fuel distributor line.

The connecting body may have a tube shape, a sleeve shape, or a pot shape, and this connecting element may be connected fixedly to the fitting of the fuel distributor line using a non-integral connection, in particular a press connection, screwed connection, clip connection, locking connection, or snap connection. This connection can be additionally secured by a securing nut or securing ring. Such connections may provide a tilting movement of the fuel injection valve in order to provide radial tolerance compensation between the cylinder head and the fuel distributor line.

Besides the mentioned non-integral connections, it is also possible to fasten the connecting element, or the intermediate components that work together with the connecting element, to the fitting with a integral connection, e.g. by laser welding, resistance welding, or soldering. Moreover, combinations of form-locking, force-locking, and integral connections can be used to achieve the desired connections to the fitting.

In addition to the decoupling of the fuel injection valve from the cylinder head, damping discs may be provided in the area of connection of the fuel distributor line and the cylinder head. These damping discs can be used singly or doubly, in the area of each screwed connection of the fuel distributor line to the cylinder head, so that the high-pressure injection system is still more effectively decoupled from the cylinder head and has better sound isolation therefrom.

The hold-down device may be provided as a stamped bent part, and may be shaped and installed in the fuel injection device such that the surfaces loaded by bending tension of the oblique segments and bearing segments of the hold-down device extend perpendicular to the cutting edges that result from the detachment of the blank for the hold-down device from the corresponding sheet. In this manner, the long-term loading capacity of the segments of the hold-down clip of the hold-down device that are loaded by bending can be increased, and an optimal hold-down force acting on the fuel injection valve can be achieved for secure fixing in the receptacle bore.

Exemplary embodiments of the present invention are shown in simplified form in the drawing, and are explained in more detail in the following description.

DETAILED DESCRIPTION

Figure 1:
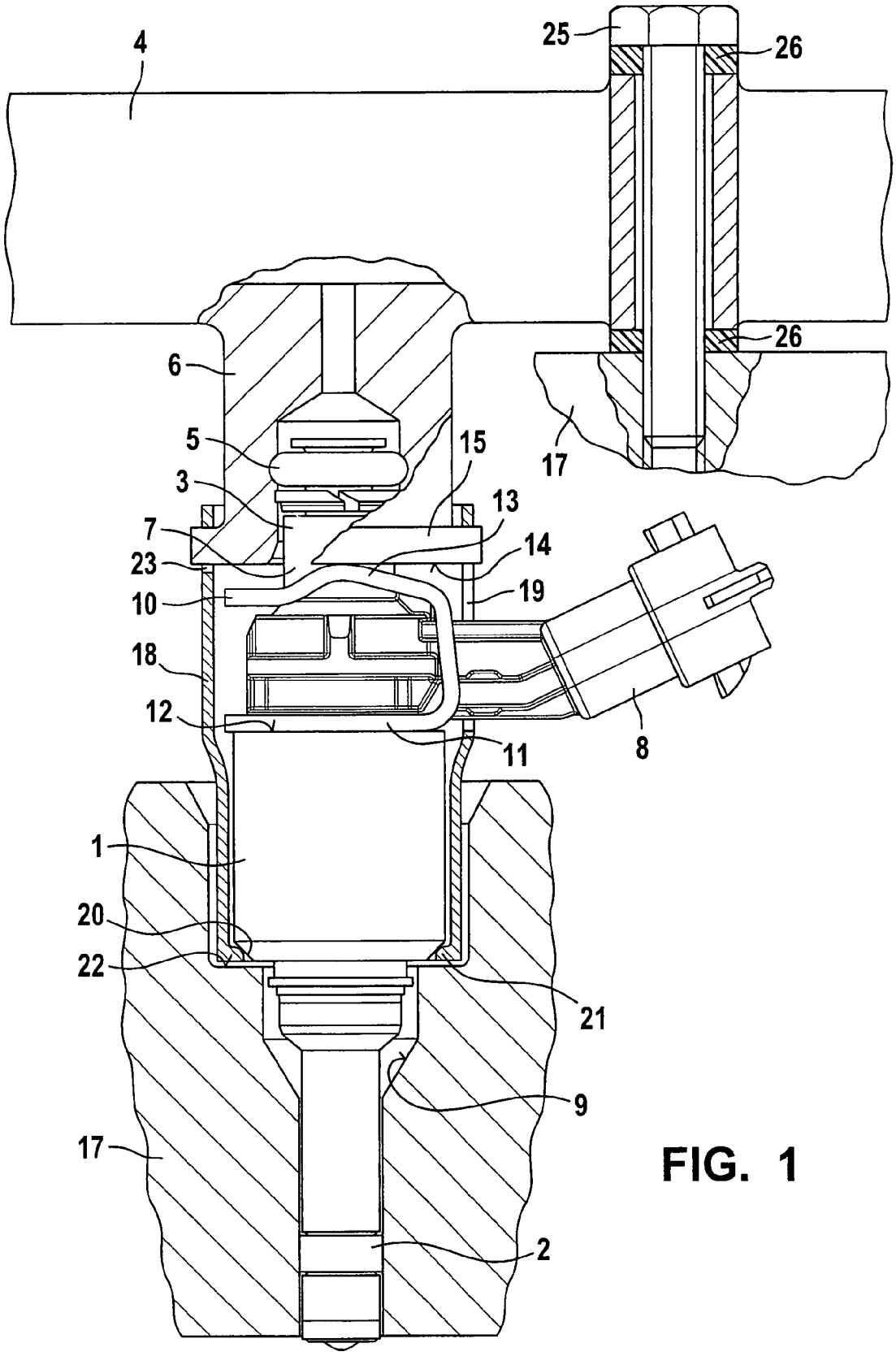
FIG. 1 shows a partial representation of a fuel injection device having a fuel injection valve that is connected to a fuel distributor line and that is decoupled in terms of solidborne sound from a cylinder head, in a first embodiment.

In FIG. 1, as a first exemplary embodiment a valve is shown in the form of an injection valve 1 for fuel injection systems of mixture-compressing externally ignited internal combustion engines, in a side view. Fuel injection valve 1 is part of a fuel injection device according to an example embodiment of the present invention. With a downstream end, fuel injection valve 1, which is realized in the form of a direct-injecting injection valve for the direct injection of fuel into a combustion chamber of the internal combustion engine, is installed in a receptacle bore 9 of a cylinder head 17 (shown only schematically). A sealing ring 2, made in particular of Teflon®, provides an optimal sealing of fuel injection valve 1 against the wall of receptacle bore 9 of cylinder head 17.

Fuel injection valve 1 has at its inlet end 3 a plug connection to a fuel distributor line 4, which is sealed by a sealing ring 5 between a fitting 6 of fuel distributor line 4, which is shown in section, and an inlet fitting 7 of fuel injection valve 1. Fuel injection valve 1 has an electrical connecting plug 8 for the electrical contacting for the actuation of fuel injection valve 1.

In order to hold fuel injection valve 1 and fuel distributor line 4 at a distance from one another without radial forces, and to hold fuel injection valve 1 down securely in receptacle bore 9 of cylinder head 17, a hold-down device 10 is provided between fuel injection valve 1 and fitting 6. Hold-down device 10 is realized as a clip-type component, e.g. as a stamped bent part. Hold-down device 10 has a partially annular base element 11, this base element 11—which does not extend fully around 360°, but rather has an extension for example of only approximately 250° to 320°—being supported on a shoulder 12 of fuel injection valve 1. With an axially flexible hold-down clip 13, which is bent away from flat base element 11, hold-down device 10 lies against a downstream end surface 14 of fitting 6 on fuel distributor line 4 in the installed state. Fitting 6 of fuel distributor line 4 has on its downstream end a partially annular protruding collar 15, on which end surface 14 is fashioned for the bearing of hold-down device 10 with its hold-down clip 13. In the area of electrical terminal plug 8, hold-down device 10 is interrupted, hold-down device 10 forming in itself a closed clip element, because hold-down clip 13 is connected in endless fashion to base element 11. In this way, hold-down device 10 can surround fuel injection valve 1, while nonetheless enabling electrical connecting plug 8 to protrude through. Hold-down clip 13 extends away from terminal plug 8 with its flexible clips.

Hold-down device 10 is detached from sheets of spring steel or high-grade steel, having a thickness of approximately 1.5 mm) for example by stamping, erosion, or laser cutting, and is subsequently brought into the desired shape by bending. Hold-down device 10 has the advantage that the surfaces of hold-down device 10 that are loaded by bending tension, in particular oblique segments and bearing segments, extend perpendicular to cutting edges that are defined when the blank for hold-down device 10 is detached from the corresponding sheet.

In conventional fuel injection devices, fuel injection valves are installed in receptacle bores of a cylinder head such that these valves abut radial shoulders of the receptacle bores immediately or indirectly via support rings. Such a design has the consequence that both due to the hold-down force of resilient hold-down devices and screwed or clamped connections of the fuel distributor line to the cylinder head, as well as due to the high pressure of the fuel inside the fuel distributor line, the fuel injection valve is pressed into the cylinder head such that an undesirably high degree of solidborne sound transmission takes place from the fuel injection valve into the cylinder head, which can be clearly audible in a negative manner.

Through the measures described herein, the solidborne transmission of sound from fuel injection valve 1 into cylinder head 17 is significantly reduced. This is achieved in that fuel injection valve 1 is connected directly to fuel distributor line 4 via a connecting body 18, but is largely decoupled from receptacle bore 9 of cylinder head 17. Fuel injection valve 1 is situated in receptacle bore 9 of cylinder head 17 such that it is mounted without contacting any surfaces or walls of receptacle bore 9 that do not extend axially parallel to fuel injection valve 1. For this purpose, fuel injection valve 1 is suspended in connecting element 18. Connecting element 18 has a tube-shaped construction, and has an opening 19 in which connecting plug 8 of fuel injection valve 1 engages. On a housing shoulder 20, fuel injection valve 1 is grasped by a holding collar 21 or by a plurality of holding collar segments of Connecting element 18, so that fuel injection valve 1 is suspended freely at a distance from a radial shoulder 22 of receptacle bore 9. Holding collar 21, or the plurality of holding collar segments of connecting element 18 that grasp fuel injection valve 1, are for example constructed so as to be rounded off towards housing shoulder 20, while housing shoulder 20 on fuel injection valve 1 has for example a conical shape.

Except for the annular material contact of sealing ring 2 in the extension of fuel injection valve 1 axially parallel to receptacle bore 9, there is no further direct physical contact of fuel injection valve 1, or indirect physical contact of fuel injection valve 1, to cylinder head 17 via connecting element 18. Here, sealing ring 2 itself ensures a good damping of the solidborne sound transmission. On the side opposite opening 19, connecting element 18 has an additional, e.g. slot-type, opening 23, in which collar 15 of fitting 6 engages, as it also does in opening 19, for the secure fastening of fuel injection valve 1 or of connecting element 18 to fuel distributor line 4.

Fuel distributor line 4 is fastened to cylinder head 17 by connecting means 25, which in the depicted exemplary embodiment are screws. In addition to the decoupling of fuel injection valve 1 from cylinder head 17, damping discs 26 may be provided in this area of connection of fuel distributor line 4 and cylinder head 17. These damping discs 26 can be situated in the area under the screw head with immediate seating on fuel distributor line 4, and/or with immediate seating on cylinder head 17, so that the high-pressure injection system made up of fuel distributor line 4 and a plurality of fuel injection valves 1 is even more effectively decoupled from cylinder head 17, and has better sound isolation therefrom. In comparison to conventional solutions, the force exerted via connecting means 25 can be reduced, because the force exerted on fuel injection valve 1 by the fuel, which is under high pressure, is absorbed by connecting element 18 directly at the point of connection of fuel injection valve 1 and fuel distributor line 4 in form-locking fashion, and is not conducted via connecting means 25.

Figure 2:
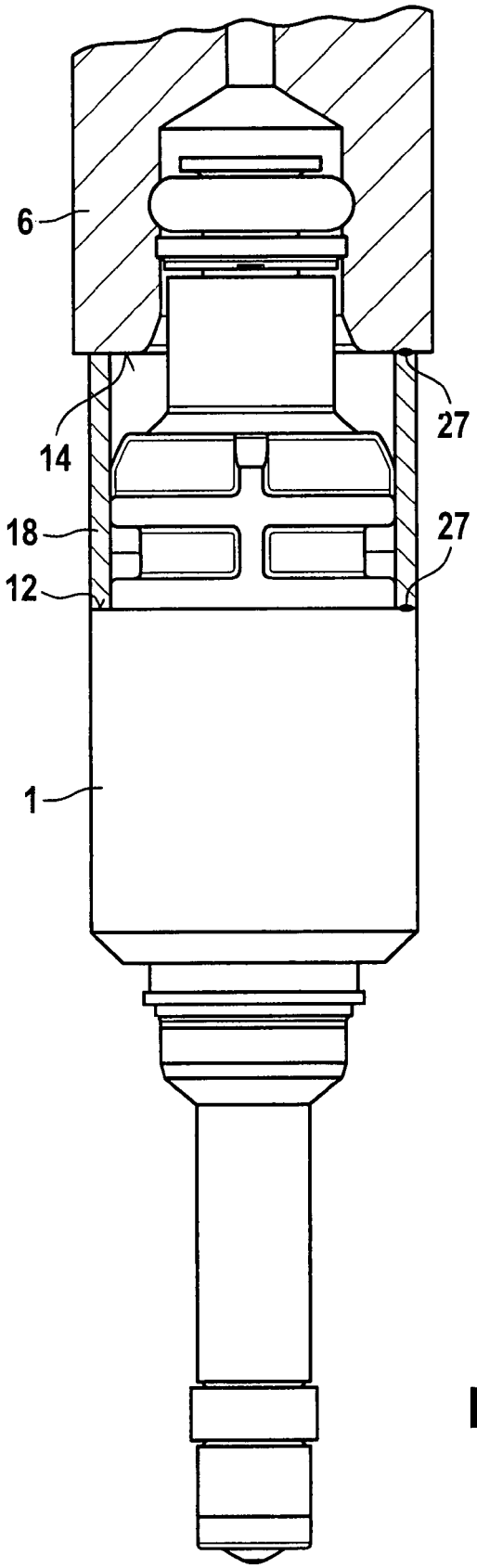
FIG. 2 shows a second exemplary embodiment of a fuel injection device.

In FIG. 2, a second exemplary embodiment of a fuel injection device is shown; in this Figure, and in all additional Figures, the representation is limited to fitting 6 of fuel distributor line 4, to fuel injection valve 1, and to connecting element 18. In the exemplary embodiment shown in FIG. 2, as connecting element 18 a sleeve is provided that determines the distance between end surface 14 of fitting 6 and shoulder 12 on fuel injection valve 1. Connecting element 18 runs for example only around 270°, and has an opening 19 for connecting plug 8 of fuel injection valve 1. Sleeve-shaped connecting element 18 is fixedly connected to fuel distributor line 4 and to fuel injection valve 1 both at end surface 14 and also at shoulder 12. The fixed connection is created for example by welding, in particular laser welding; weld seams or weld points 27 can be provided.

Figure 3:
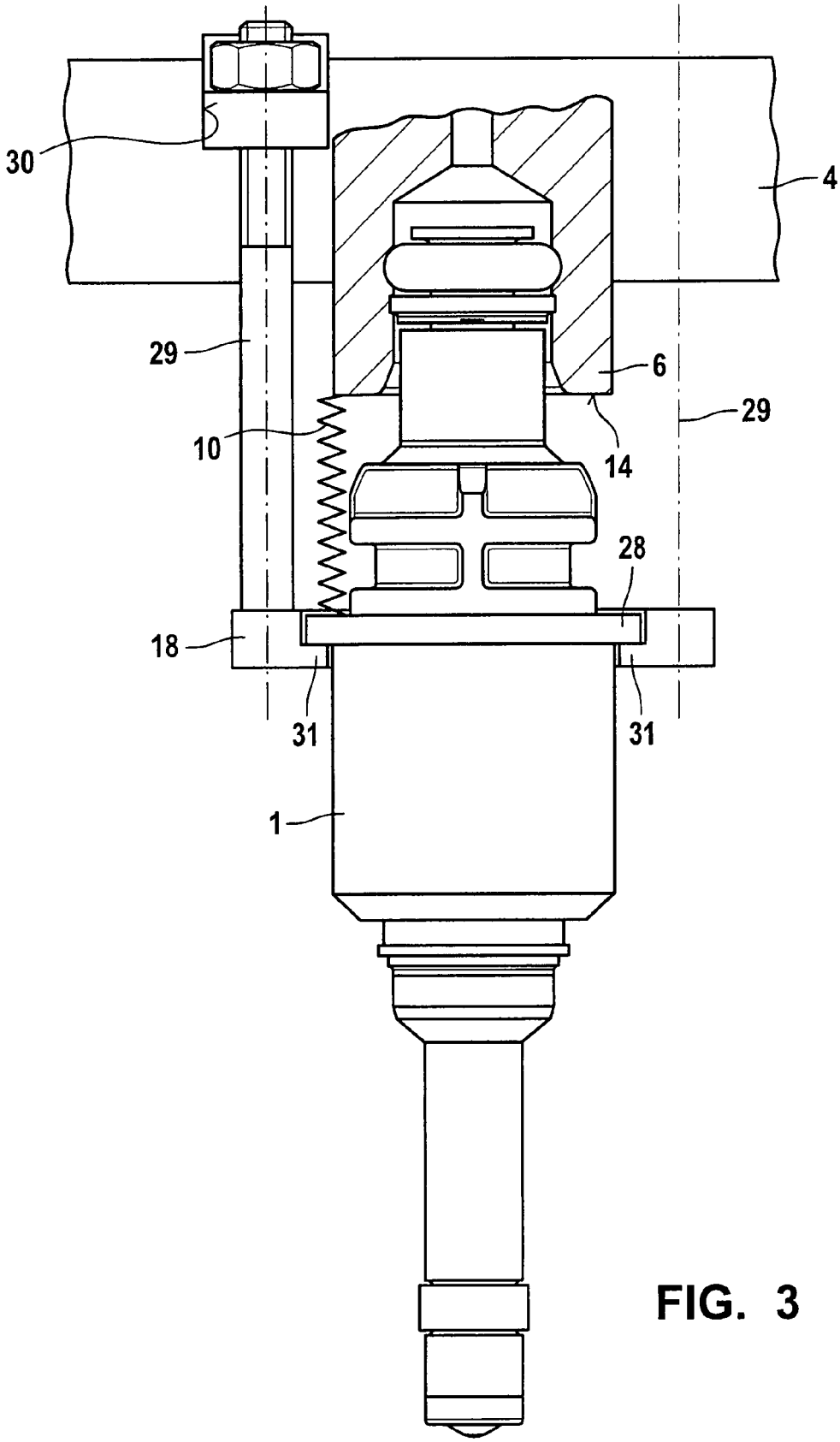
FIG. 3 shows a third exemplary embodiment of a fuel injection device.

In FIG. 3, a third exemplary embodiment of a fuel injection device is shown. In this embodiment, an annular connecting element 18 is provided that grasps fuel injection valve 1 at a flange 28. For example two axial screws 29 stand in immediate effective connection with this flange 28, these screws being supported on the one hand in a receptacle bore 30 of fuel distributor line 4, this bore being situated for example on a lateral projection on fuel distributor line 4, and on the other hand engaging in connecting element 18. In this manner, fuel injection valve 1 can be drawn into fitting 6. Connecting element 18 has for example an annular peripheral construction, for example two grasping segments 31 being provided that protrude inward toward fuel injection valve 1 in the area of the two axial screws 29, these grasping segments grasping directly under flange 28. In this Figure and in all additional Figures, hold-down device 10 is shown only symbolically as a spring; ideally, hold-down device 10 is fashioned as a clip element according to FIG. 1 and according to the corresponding description relating to FIG. 1. In a manner similar to the first exemplary embodiment according to FIG. 1, hold-down device 10 is clamped between end surface 14 of fitting 6 and flange 28 on fuel injection valve 1.

Figure 4:
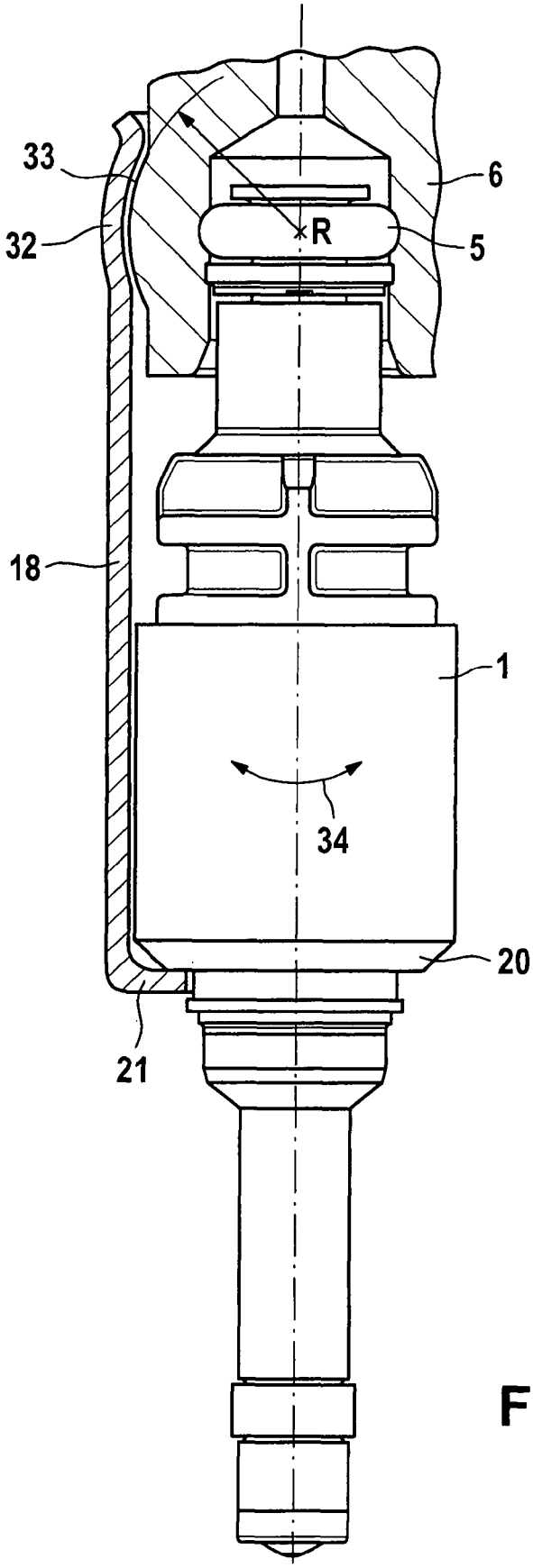
FIG. 4 shows a fourth exemplary embodiment of a fuel injection device.

In FIG. 4, a fourth exemplary embodiment of a fuel injection device is shown. This fuel injection device is distinguished in that a connecting element 18 is fashioned that on the one hand grasps fuel injection valve 1 in the area of a housing shoulder 20 with a holding collar 21, and on the other hand is connected to fitting 6 via a non-integral connection, e.g. a clip connection. Connecting element 18 is tube-shaped, and has an opening 19 in which terminal plug 8 of fuel injection valve 1 can engage. Outside this opening 19, connecting element 18 can have a 360° peripheral construction. On housing shoulder 20, fuel injection valve 1 is grasped by holding collar 21 or a plurality of holding collar segments of connecting element 18, so that fuel injection valve 1 is freely suspended at a distance from a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. On its end facing fitting 6, connecting element 18 has a first locking means 32, e.g. in the form of a bulge, while on the periphery of fitting 6 a second locking means 33, e.g. in the form of an arch, is provided, which together correspond to a locking or clip connection. Arch 33 on fitting 6 is constructed for example with a radius R whose midpoint is situated on the valve longitudinal axis in the center of sealing ring 5. Double arrow 34 is intended to indicate that connecting element 18 may provide a tilting movement of fuel injection valve 1 for radial tolerance compensation between cylinder head 17 and fuel distributor line 4.

Figure 5:
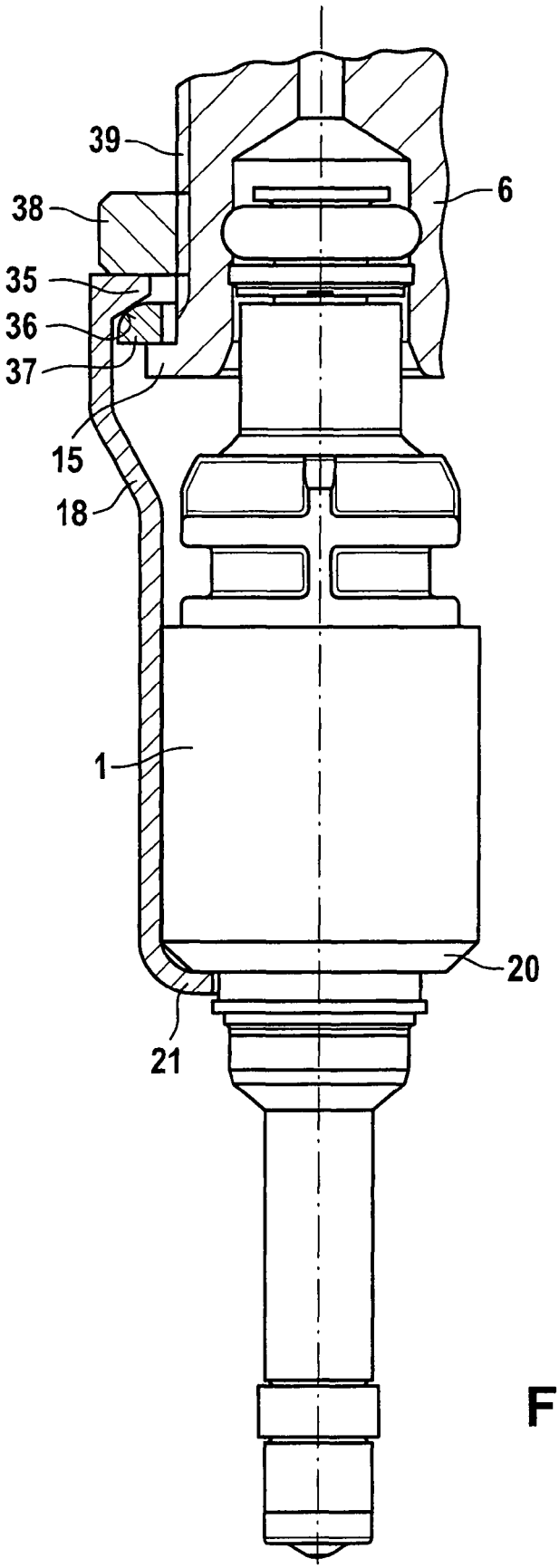
FIG. 5 shows a fifth exemplary embodiment of a fuel injection device.

FIG. 5 shows a fifth exemplary embodiment of a fuel injection device. In a slight modification of the embodiment according to FIG. 4, this fuel injection device is also distinguished in that a valve element 18 is fashioned that on the one hand grasps fuel injection valve 1 in the area of a housing shoulder 20 with a holding collar 21, and on the other hand is connected to fitting 6 via a non-integral connection, here a locking connection with screw securing. Connecting element 18 is tube-shaped and has a stepped construction, and has an opening 19 for the engagement of connecting plug 8 of fuel injection valve 1. Outside this opening 19, connecting element 18 can have a 360° peripheral construction. On housing shoulder 20, fuel injection valve 1 is grasped by holding collar 21 or by a plurality of holding collar segments of connecting element 18, so that fuel injection valve 1 is freely suspended at a distance from a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. On its end facing fitting 6, connecting element 18 has an annular collar 35 that has a conical support surface 36. With this support surface 36, annular collar 35 of connecting element 18 is supported on a fastening ring 37 that has for example a curved surface that faces annular collar 35 and that abuts a downstream collar 15 of fitting 6. The connection is secured against slippage of connecting element 18 from fastening ring 37, and thus from fitting 6, by a securing nut 38 that has an inner threading that corresponds to an outer threading 39 on the periphery of fitting 6.

Figure 6:
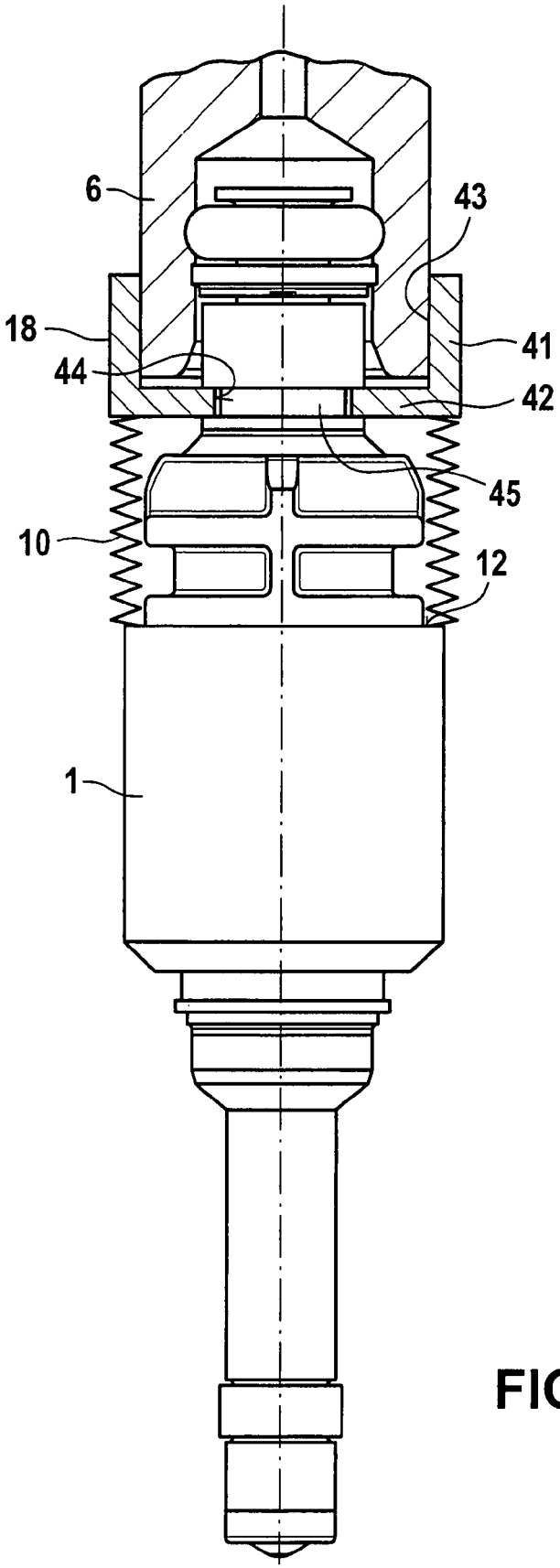
FIG. 6 shows a sixth exemplary embodiment of a fuel injection device.

FIG. 6 shows a sixth exemplary embodiment of a fuel injection. In the exemplary embodiment shown in FIG. 6, a pot-shaped sleeve is provided as a connecting element 18 that is situated securely and fixedly at the downstream end of fitting 6. Connecting element 18 has a jacket segment 41 and a base segment 42, jacket segment 41 being fastened by a form-locking and/or force-locking connection, e.g. by pressing 43 on the periphery of fitting 6. Here, given a force-locking connection, the penetration depth of fuel injection valve 1 into fitting 6 can be adjusted via the axial position of connecting element 18. In base segment 42, a center opening 44 is provided through which a tapered area 45 of fuel injection valve 1 extends. In order to enable introduction of fuel injection valve 1 into opening 44, in base segment 42 of connecting element 18 a slot-type expansion, or an expansion as a hole having a larger radius, is fashioned going out from opening 44. Hold-down device 10 is clamped between base segment 42 of connecting element 18 and shoulder 12 on fuel injection valve 1.

Figure 7:
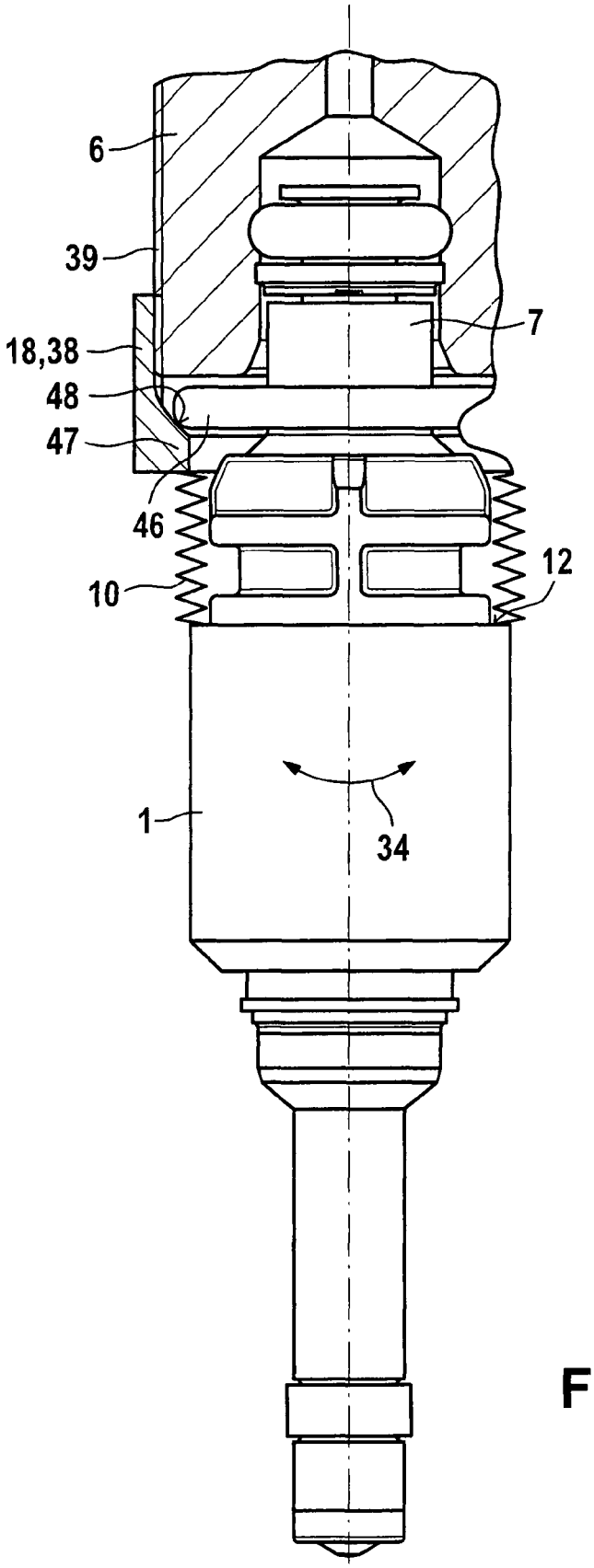
FIG. 7 shows a seventh exemplary embodiment of a fuel injection device.

FIG. 7 shows a seventh exemplary embodiment of a fuel injection device. In the area of its inlet fitting 7, fuel injection valve 1 has a flange 46 that extends radially outward. Connecting element 18 is realized in the form of a securing nut 38. On its end facing fitting 6, connecting element 18 has a segment containing an inner threading to which an annular collar 47 is connected that has a conical support surface 48. With this support surface 48, annular collar 47 of connecting element 18, 38 is supported against flange 46, which has for example a curved surface facing annular collar 47. Securing nut 38 corresponds to an outer threading 39 on the periphery of fitting 6. With securing nut 38 that engages on flange 46 of fuel injection valve 1, the penetration depth of fuel injection valve 1 in fitting 6 can be adjusted. Hold-down device 10 is clamped between annular collar 47 of securing nut 38 and shoulder 12 on fuel injection valve 1.

Figure 8:
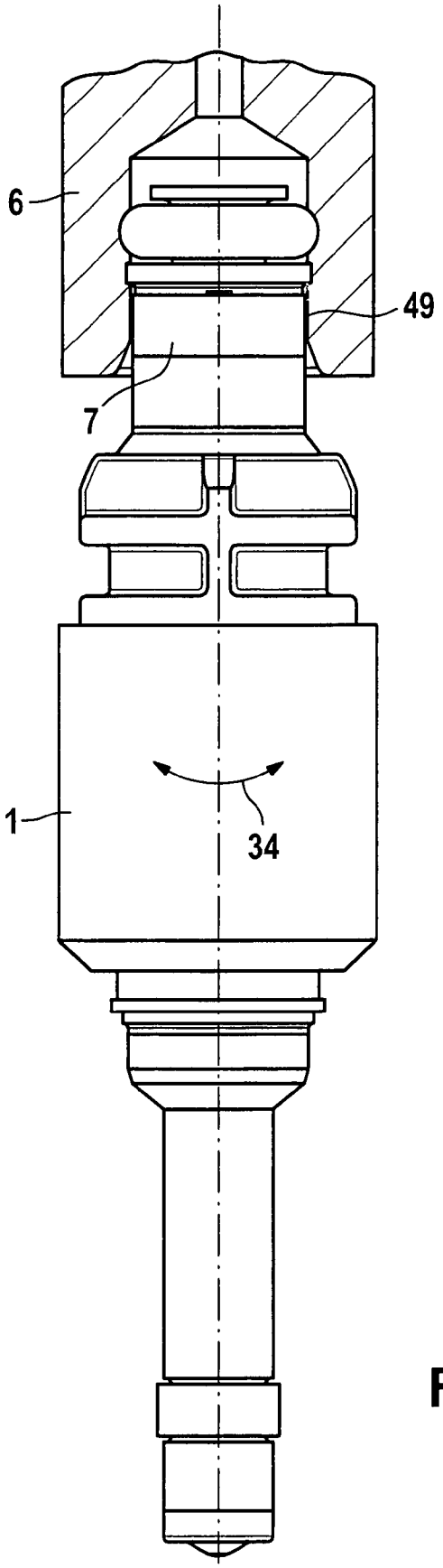
FIG. 8 shows an eighth exemplary embodiment of a fuel injection device.

FIG. 8 shows an eighth exemplary embodiment of a fuel injection device. This fuel injection device is distinguished in particular by its very simple design. Fuel injection valve 1 is fastened immediately with its inlet fitting 7 in fitting 6 of fuel distributor line 4. The fixed connection 49 is achieved for example by a force-locking connection, a form-locking connection, and/or an integral connection. Among others, welded or soldered connections are conceivable here, as well as pressing inlet fitting 7 into fitting 6 in order to form a metallic press fit. Here, the penetration depth of fuel injection valve 1 into fitting 6 is adjustable. The tolerance compensation indicated by double arrow 34 is here possible exclusively via a flexibility of fuel injection valve 1 that is predictable in a suitable manner.

Figure 9:
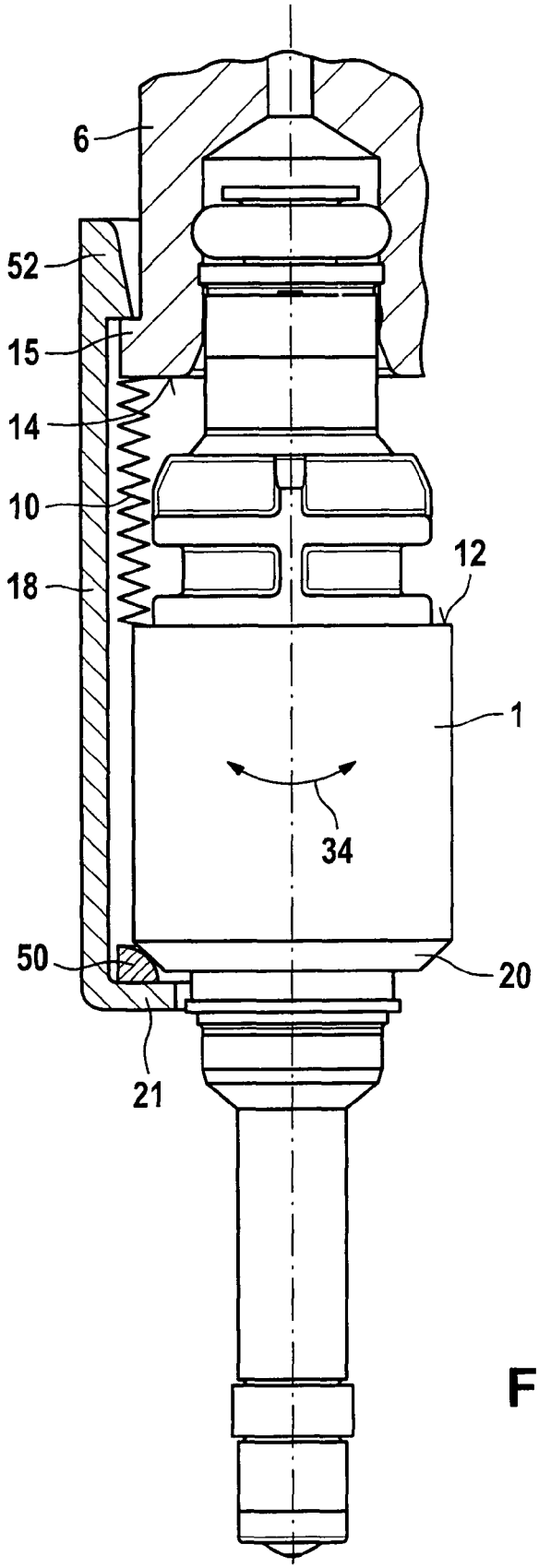
FIG. 9 shows a ninth exemplary embodiment of a fuel injection device.
Figure 11:
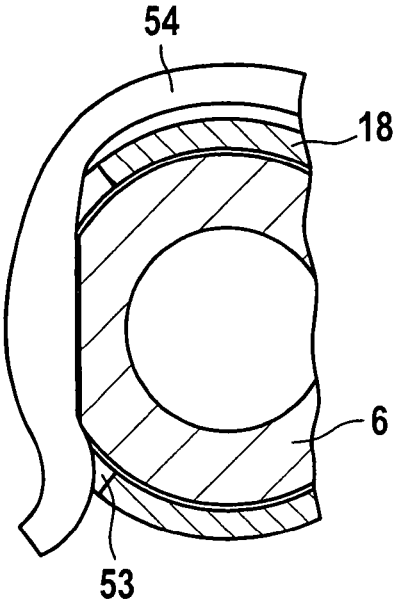
FIG. 11 shows a section through the fuel injection device along the line XI-XI in FIG. 10.
Figure 10:
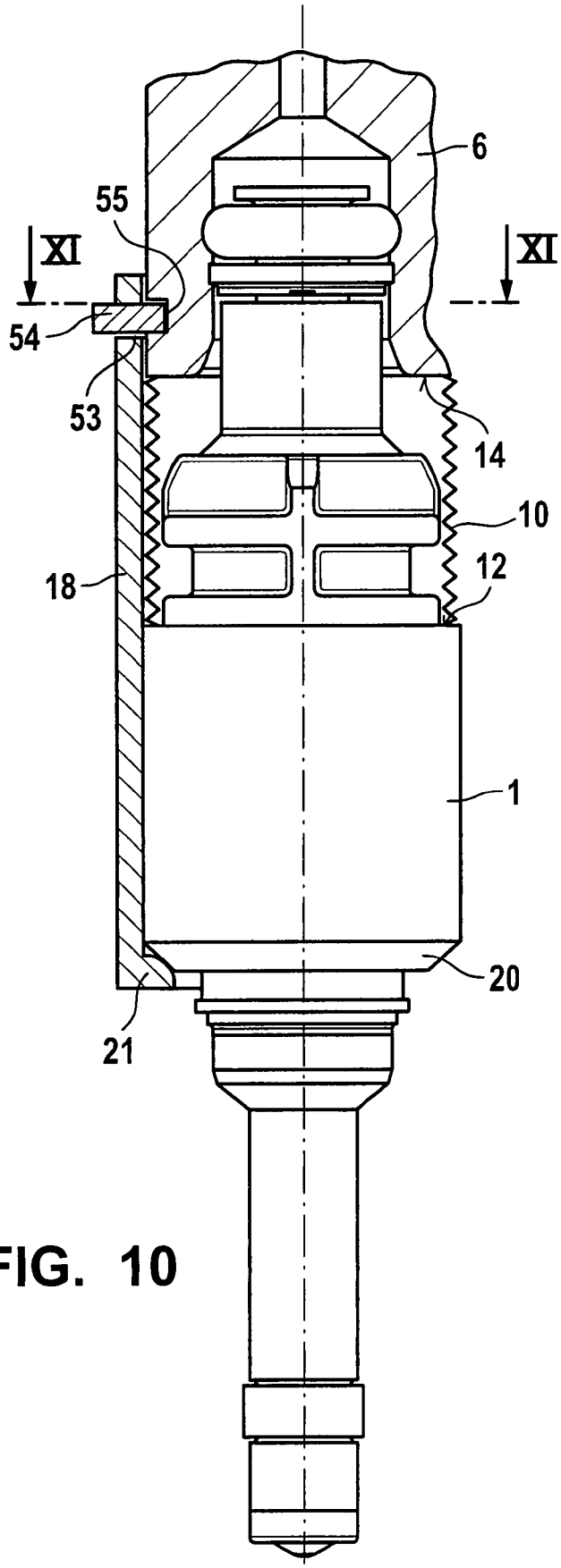
FIG. 10 shows a tenth exemplary embodiment of a fuel injection device.

FIG. 9 shows a ninth exemplary embodiment of a fuel injection device. This fuel injection device is distinguished in that a connecting element 18 is formed that on the one hand grasps fuel injection valve 1 in the area of a housing shoulder with a holding collar 21, and on the other hand is connected to fitting 6 via a non-integral connection, e.g. a snap connection. Connecting element 18 is tube-shaped, and has an opening 19 for the engagement of connecting plug 8 of fuel injection valve 1. Outside this opening 19, connecting element 18 can be can have a 360° peripheral construction. On housing shoulder 20, fuel injection valve 1 is grasped by holding collar 21 or by a plurality of holding collar segments of connecting element 18, so that fuel injection valve 1 is suspended freely at a distance from a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. Between housing shoulder 20 and holding collar 21, another support ring 50 is placed that has a curved bearing surface facing housing shoulder 20. In this way, fuel injection valve 1 can slide relative to connecting element 18 on support ring 50, and can compensate tolerances. On its end facing fitting 6, connecting element 18 has a locking means 52, e.g. in the form of one or more locking noses that overlap a collar 15 at the downstream end of fitting 6, and thus together correspond to a locking connection. Double arrow 34 is intended to indicate that connecting element 18 may provide a tilting movement of fuel injection valve 1 in order to provide radial tolerance compensation between cylinder head 17 and fuel distributor line 4. Similar to the first exemplary embodiment according to FIG. 1, hold-down device 10 is clamped between end surface 14 of fitting 6 and shoulder 12 on fuel injection valve 1. In FIGS. 10 and 11, a tenth exemplary embodiment of a fuel injection device is shown. This fuel injection device is distinguished in that a connecting element 18 is fashioned that on the one hand grasps fuel injection valve 1 in the area of a housing shoulder 20 with a holding collar 21, and on the other hand is connected to fitting 6 via a non-integral connection, e.g. a snap connection. Connecting element 18 is tube-shaped, and has an opening 19 for the engagement of connecting plug 8 of fuel injection valve 1. Outside this opening 19, connecting element 18 can have a 360° peripheral construction. On housing shoulder 20, fuel injection valve 1 is grasped by holding collar 21, or by a plurality of holding collar segments of connecting element 18, so that fuel injection valve 1 is freely suspended at a distance from a radial shoulder 22 of receptacle bore 9. Holding collar 21, or the plurality of holding collar segments of connecting element 18 that grasp fuel injection valve 1, are for example constructed so as to be curved towards housing shoulder 20, while housing shoulder 20 on fuel injection valve 1 runs for example with a conical shape. On its end facing fitting 6, connecting element 18 has two slots 53 situated opposite one another, seen along the periphery, which have for example an extension of approximately 90°. Slots 53 are engaged by a clip-type, U-shaped snap ring 54. In the peripheral area of slots 53 in connecting element 18, snap ring 54 additionally engages in two slot-shaped grooves 55 on the periphery of fitting 6 for the secure fastening of connecting element 18 to fuel distributor line 4. Similar to the first exemplary embodiment according to FIG. 1, hold-down device 10 is clamped between end surface 14 of fitting 6 and shoulder 12 on fuel injection valve 1.

Figure 12:
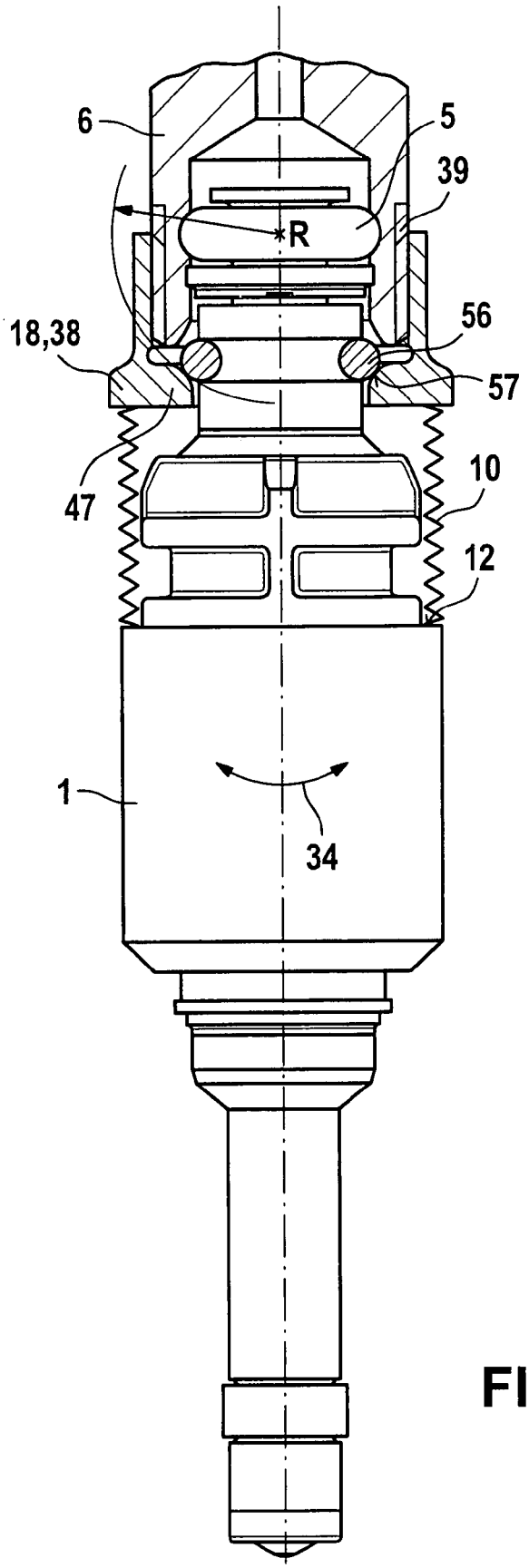
FIG. 12 shows an eleventh exemplary embodiment of a fuel injection device.

FIG. 12 shows an eleventh exemplary embodiment of a fuel injection device. In the area of its inlet fitting 7, fuel injection valve 1 has a wire ring 56 that is inserted in a groove. Connecting element 18 is realized in the form of a securing nut 38. On its end facing fitting 6, connecting element 18 has a segment containing an inner threading, to which an annular collar 47 is connected that has a curved support surface 57 in the form of a ball socket. With this support surface 57, annular collar 47 of connecting element 18, 38 is supported on wire ring 56, whose curvature is accepted in annular collar 47. Support surface 57 on annular collar 47 of securing nut 38 is constructed for example with a radius R whose midpoint is situated on the valve longitudinal axis in the center of sealing ring 5. Securing nut 38 corresponds with an outer threading 39 on the periphery of fitting 6. With a securing nut 38 that engages on wire ring 56 of fuel injection valve 1, the penetration depth of fuel injection valve 1 in fitting 6 can be adjusted. Hold-down device 10 is clamped between annular collar 47 of securing nut 38 and shoulder 12 on fuel injection valve 1. Double arrow 34 is intended to indicate that connecting element 18 may provide a tilting movement of fuel injection valve 1 for radial tolerance compensation between cylinder head 17 and fuel distributor line 4.

Figure 13:
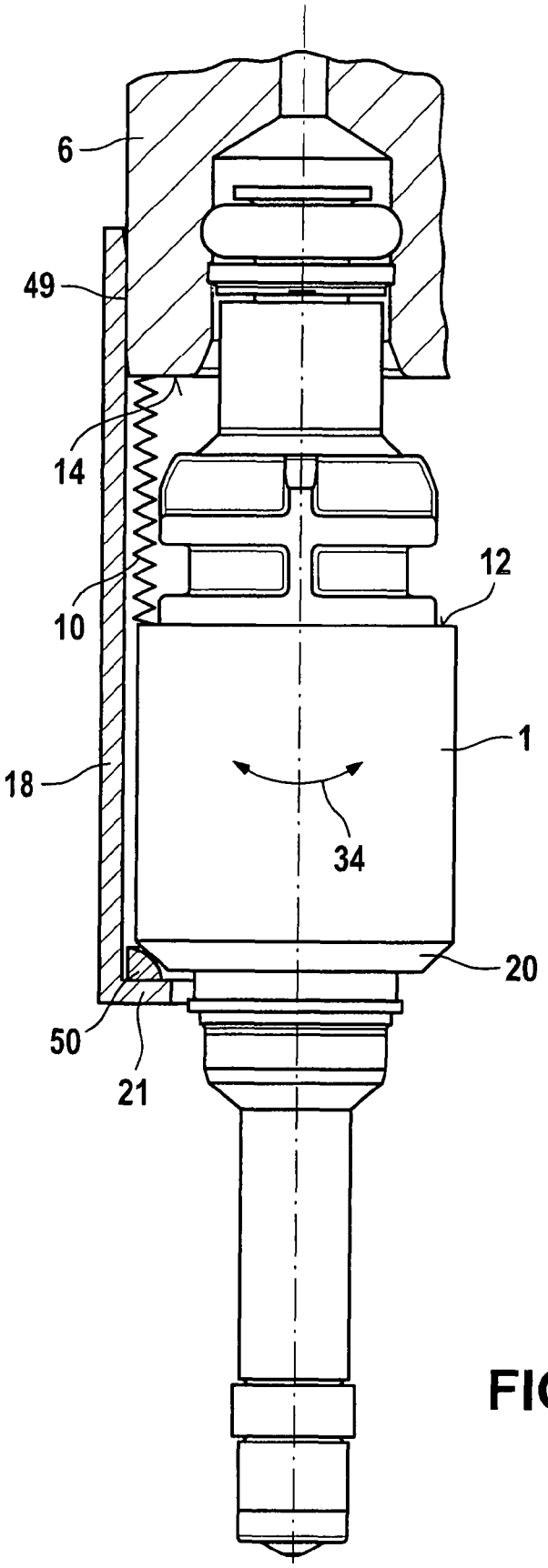
FIG. 13 shows a twelfth exemplary embodiment of a fuel injection device.

FIG. 13 shows a twelfth exemplary embodiment of a fuel injection device. This fuel injection device is distinguished in that a connecting element 18 is fashioned that on the one hand grasps fuel injection valve 1 in the area of a housing shoulder 20 with a holding collar 21, and on the other hand is connected to fitting 6 via a force-locking and/or integral connection. Connecting element 18 is tube-shaped, and has an opening 19 for the engagement of connecting plug 8 of fuel injection valve 1. Outside this opening 19, connecting element 18 can have a 360° peripheral construction. On housing shoulder 20, fuel injection valve 1 is grasped by holding collar 21, or by a plurality of holding collar segments of connecting element 18, so that fuel injection valve 1 is freely suspended at a distance from a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. Between housing shoulder 20 and holding collar 21, another support ring 50 is placed that has a curved bearing surface facing housing shoulder 20. In this manner, fuel injection valve 1 can slide on support ring 50 in relation to connecting element 18, and can compensate tolerances. On its end facing fitting 6, connecting element 18 is fastened immediately on the outer periphery of fitting 6 of fuel distributor line 4. The fixed connection 49 is achieved for example by a force-locking connection, a form-locking connection, and/or an integral connection. Among others, welded or soldered connections are possible, as is the pressing of connecting element 18 onto fitting 6 in order to form a metallic press fit. Here, the penetration depth of fuel injection valve 1 into fitting 6 can be adjusted. Double arrow 34 is intended to indicate that connecting element 18 may provide a tilting movement of fuel injection valve 1 for radial tolerance compensation between cylinder head 17 and fuel distributor line 4. Similar to the first exemplary embodiment according to FIG. 1, hold-down device 10 is clamped between end surface 14 of fitting 6 and shoulder 12 on fuel injection valve 1.

Figure 14:
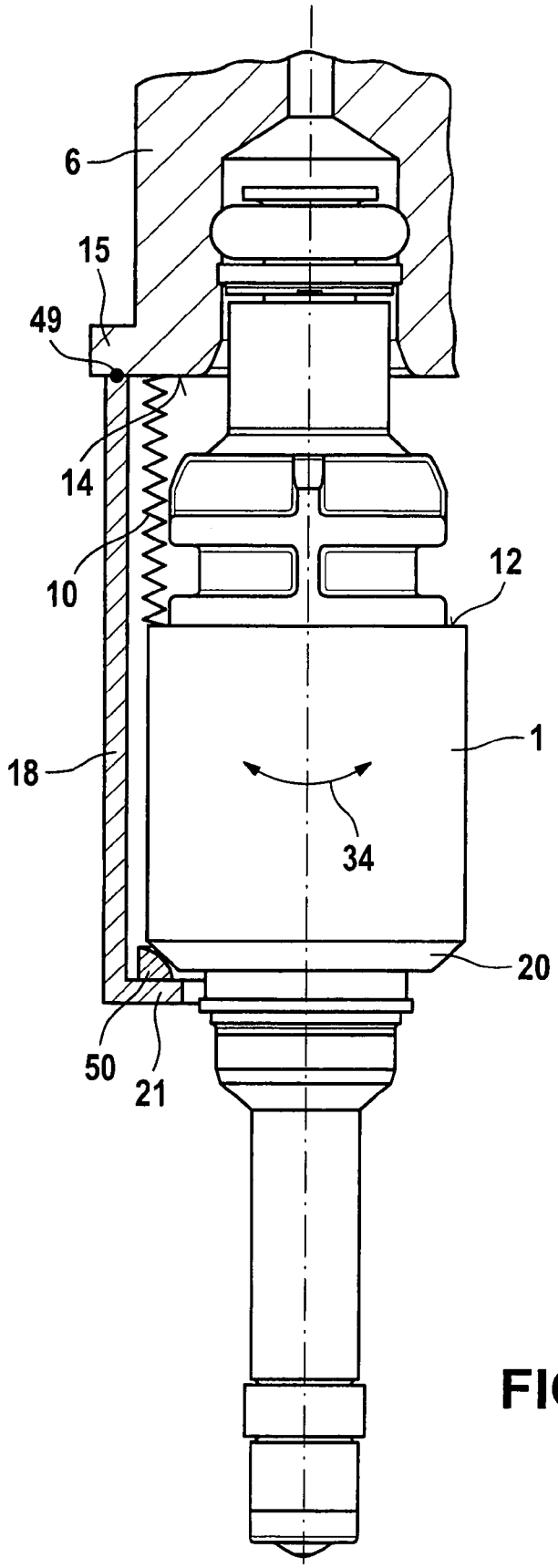
FIG. 14 shows a thirteenth exemplary embodiment of a fuel injection device.

FIG. 14 shows a thirteenth exemplary embodiment of a fuel injection device. This fuel injection device is distinguished in that a connecting element 18 is fashioned that on the one hand grasps fuel injection valve 1 in the area of a housing shoulder 20 with a holding collar 21, and on the other hand is connected to fitting 6 via an integral connection. Connecting element 18 is tube-shaped, and has an opening 19 for the engagement of connecting plug 8 of fuel injection valve 1. Outside this opening 19, connecting element 18 can have a 360° peripheral construction. On housing shoulder 20, fuel injection valve 1 is grasped by holding collar 21, or by a plurality of holding collar segments of connecting element 18, so that fuel injection valve 1 is freely suspended in relation to a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. Between housing shoulder 20 and holding collar 21, another support ring 50 is placed that has a curved bearing surface facing housing shoulder 20. In this manner, fuel injection valve 1 can slide on support ring 50 in relation to connecting element 18 and can compensate tolerances. On its end facing fitting 6, connecting element 18 is fastened immediately on downstream end surface 14 of a radially outward-protruding collar 15 of fitting 6 of fuel distributor line 4. The fixed connection 49 is achieved for example by resistance welding. Similar to the first exemplary embodiment according to FIG. 1, hold-down device 10 is clamped between end surface 14 of fitting 6 and shoulder 12 on fuel injection valve 1.

Figure 15:
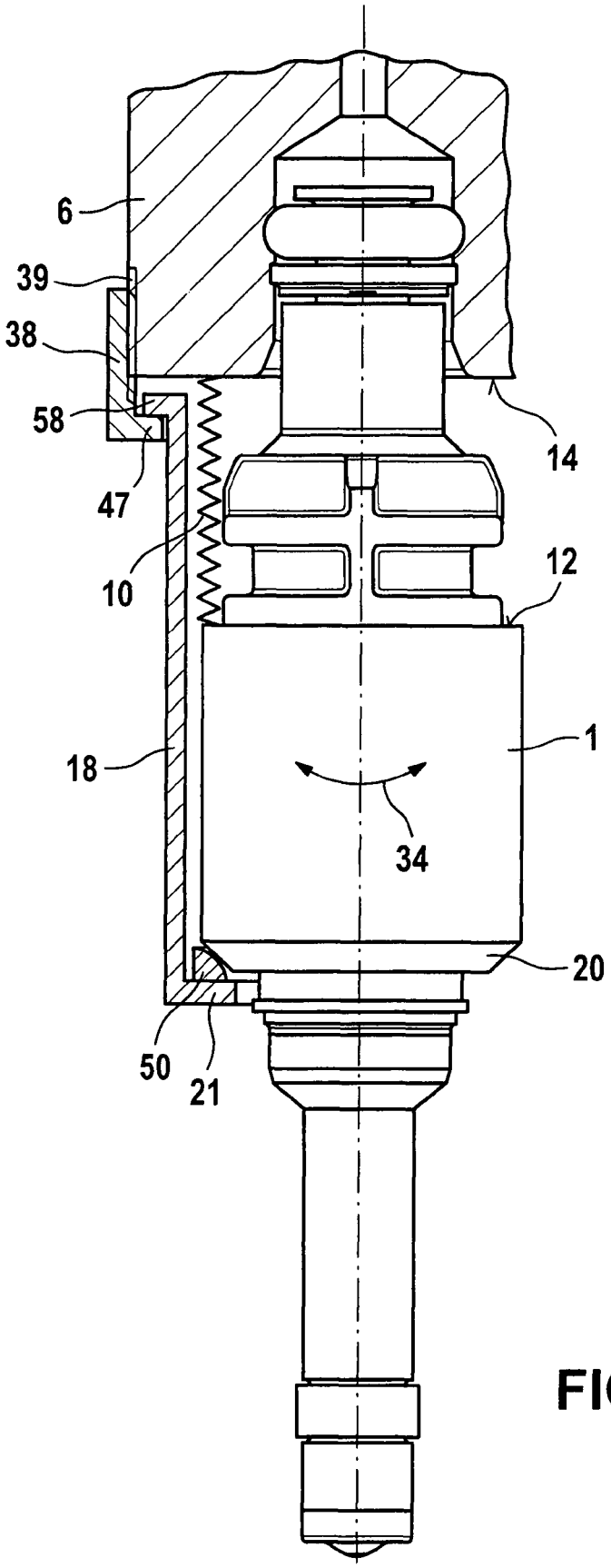
FIG. 15 shows a fourteenth exemplary embodiment of a fuel injection device.

FIG. 15 shows a 14th exemplary embodiment of a fuel injection device. This fuel injection device is distinguished in that a connecting element 18 is fashioned that on the one hand grasps fuel injection valve 1 in the area of a housing shoulder 20 with a holding collar 21, and on the other hand is connected to fitting 6 via a screw connection. Connecting element 18 is tube-shaped, and has an opening 19 for the engagement of connecting plug 8 of fuel injection valve 1. Outside this opening 19, connecting element 18 can have a 360° peripheral construction. On housing shoulder 20, fuel injection valve 1 is grasped by holding collar 21, or by a plurality of holding collar segments of connecting element 18, so that fuel injection valve 1 is freely suspended in relation to a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. Between housing shoulder 20 and holding collar 21, another support ring 50 is placed that has a curved support surface facing housing shoulder 20. In this manner, fuel injection valve 1 can slide on support ring 50 in relation to connecting element 18 and can compensate tolerances. On its end facing fitting 6, connecting element 18 is grasped by a securing nut 38. On its end facing fitting 6, securing nut 38 has a segment containing an inner threading to which an annular collar 47 is connected. This annular collar 47 grasps a radially outward-protruding collar 58 of connecting element 18. Securing nut 38 corresponds with an outer threading 39 on the periphery of fitting 6. With a securing nut 38 that engages on collar 58 of connecting element 18, the penetration depth of fuel injection valve 1 in fitting 6 can be adjusted. Double arrow 34 is intended to indicate that connecting element 18 may provide a tilting movement of fuel injection valve 1 for radial tolerance compensation between cylinder head 17 and fuel distributor line 4. Similar to the first exemplary embodiment according to FIG. 1, hold-down device 10 is clamped between end surface 14 of fitting 6 and shoulder 12 on fuel injection valve 1.

Figure 16:
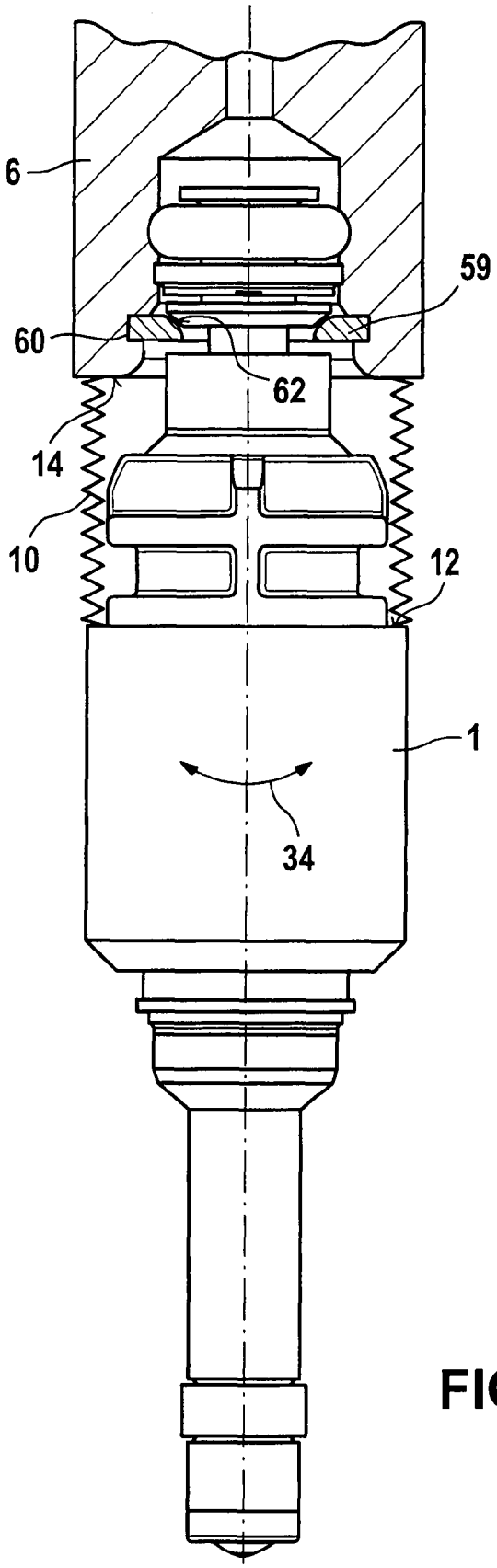
FIG. 16 shows a fifteenth exemplary embodiment of a fuel injection device.

FIG. 16 shows a fifteenth exemplary embodiment of a fuel injection device. This fuel injection device is distinguished in that connecting element 18 is merely a slotted snap ring 59. Snap ring 59 engages in a tapered segment of inlet fitting 7 of fuel injection valve 1. In fitting 6, a groove 60 is provided in which snap ring 59 locks securely and fixedly. In order to grasp fuel injection valve 1, snap ring 59 has a conical or curved spherical bearing surface 62. Similar to the first exemplary embodiment according to FIG. 1, hold-down device 10 is clamped between end surface 14 of fitting 6 and shoulder 12 on fuel injection valve 1.

Figure 17:
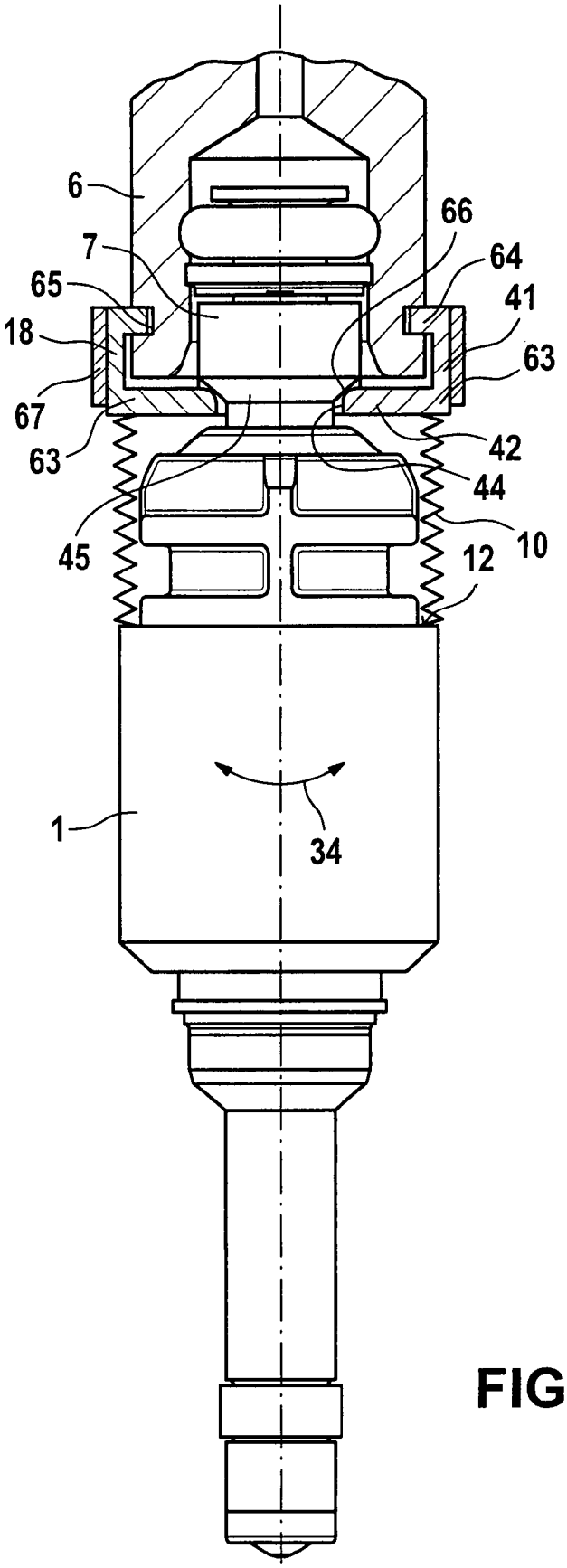
FIG. 17 shows a sixteenth exemplary embodiment of a fuel injection device.

FIG. 17 shows a sixteenth exemplary embodiment of a fuel injection device. In the exemplary embodiment shown in FIG. 17, as connecting element 18 a pot-shaped sleeve is provided that is securely and fixedly situated on the downstream end of fitting 6. Connecting element 18 has a two-part construction, i.e., it is made up of two semi-annular ring elements 63. Each ring element 63 has a jacket segment 41 and a base segment 42, each jacket segment 41 situated opposite base segment 42 going over into a hook-shaped locking segment 64. Locking segments 64 of connecting element 18 engage securely in two grooves 65 on the periphery of fitting 6. In base segment 42, a center opening 44 is provided that is engaged by a tapered area 45 of fuel injection valve 1, tapered area 45 on inlet fitting 7 having a conical flank as bearing surface 66. Center opening 44 in base segment 42 has a curved spherical limiting edge that corresponds to support surface 66 of tapered area 45, and can slide along it slightly. For the clamping of the two annular elements 63 on the periphery of fitting 6, a closed clamp ring 67 is pushed over the two ring elements 63. Hold-down device 10 is clamped between base segment 42 of connecting element 18 and shoulder 12 on fuel injection valve 1.

Figure 18:
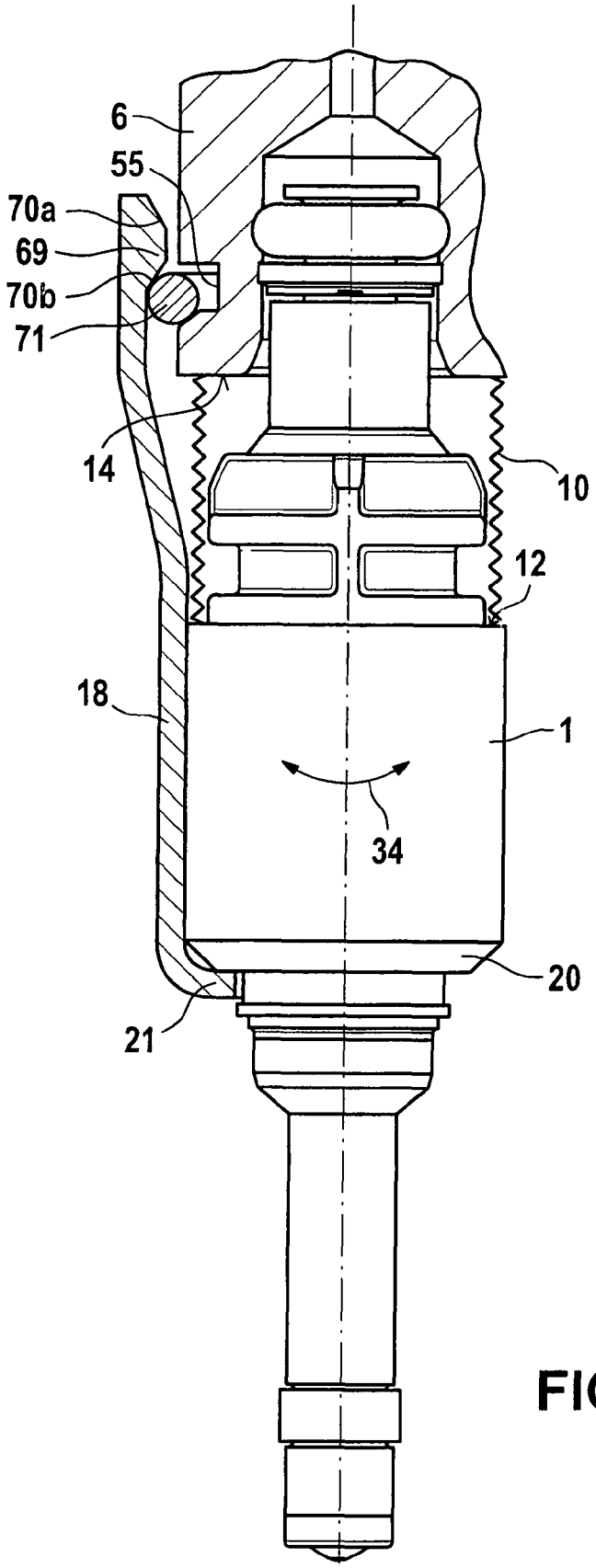
FIG. 18 shows a seventeenth exemplary embodiment of a fuel injection device.

FIG. 18 shows a seventeenth exemplary embodiment of a fuel injection device. This fuel injection device is distinguished in that a connecting element 18 is fashioned that on the one hand grasps fuel injection valve 1 in the area of a housing shoulder 20 with a holding collar 21, and on the other hand is connected to fitting 6 via a non-integral connection, here a snap or locking connection. Connecting element 18 is tube-shaped, and has an opening that expands opposite the direction of flow, and has an opening 19 for the engagement of connecting plug 8 of fuel injection valve 1. Outside this opening 19, connecting element 18 can have a 360° peripheral construction. On housing shoulder 20, fuel injection valve 1 is grasped by holding collar 21, or by a plurality of holding collar segments of connecting element 18, so that fuel injection valve 1 is freely suspended at a distance from a radial shoulder 22 of receptacle bore 9. Holding collar 21, or the plurality of holding collar segments of connecting element 18 that grasp fuel injection valve 1, are for example constructed with right-angled ends, while housing shoulder 20 on fuel injection valve 1 runs for example with a conical shape. On its end facing fitting 6, connecting element 18 has an annular overlap segment 69 that has two conical limiting surfaces 70*a*, 70*b*. For the secure fastening of fuel injection valve 1 on fuel distributor line 4 via connecting element 18, a groove 55 is provided on the periphery of fitting 6, in which an open spring ring 71 is placed. During the installation of connecting element 18 in the upstream direction, first limiting surface 70*a* first pushes spring ring 71 into groove 55 until overlap segment 69 has slid over and past spring ring 71. In the assembled state of connecting element 18, second limiting surface 70*b* of overlap segment 69 of connecting element 18 is supported on spring ring 71, which due to its spring tension slides slightly radially outward out of groove 55 again and clamps connecting element 18 to fitting 6. Similar to the first exemplary embodiment according to FIG. 1, hold-down device 10 is clamped between end surface 14 of fitting 6 and shoulder 12 on fuel injection valve 1.

What is claimed is:

1. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element is arranged such that the fuel injection valve and the connecting element do not directly contact, and do not indirectly contact via contact through one or more other elements, any surfaces or walls of the cylinder head, including any surfaces or walls of the receptacle bore of the cylinder head, that do not extend axially parallel to the fuel injection valve.

2. The fuel injection device according to claim 1, wherein the connecting element is fastened directly on the fitting of the fuel distributor line.

3. The fuel injection device according to claim 1, wherein the connecting element has a tube-shaped construction.

4. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve;

wherein the at least one of (a) the holding collar and (b) the plurality of holding collar segments are fashioned so as to be rounded towards the one of the shoulder and the flange of the fuel injection valve and grasp the fuel injection valve, the one of the shoulder and the flange having a conical shape.

5. The fuel injection device according to claim 4, wherein a support ring is placed between the at least one of (a) the holding collar and (b) the holding collar segments of the connecting element and the one of the shoulder and the flange.

6. The fuel injection device according to claim 5, wherein the support ring is constructed so as be rounded towards the one of the shoulder and the flange.

7. The fuel injection device according to claim 1, wherein the fitting has on a downstream end a partially annular peripheral protruding collar that engages in an opening on the connecting element.

8. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element:

is arranged such that the fuel injection valve and the connecting element do not directly contact, and do not indirectly contact via contact through one or more other elements, any surfaces or walls of the receptacle bore of the cylinder head that do not extend axially parallel to the fuel injection valve;

has an annular construction; and is connected to the fuel distributor line by axial screws.

9. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element:

is arranged such that the fuel injection valve and the connecting element do not directly contact, and do not indirectly contact via contact through one or more other elements, any surfaces or walls of the receptacle bore of the cylinder head that do not extend axially parallel to the fuel injection valve;

has a tube-shaped construction; and is connected in a fixed manner to the fitting by at least one of (a) a non-integral connection, (b) a clip connection, (c) a locking connection and (d) a snap connection.

10. The fuel injection device according to claim 9, wherein the connection between the connecting element and the fitting is secured by a securing nut.

11. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element:

is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and is constructed with a pot shape, a base segment surrounding the fuel injection valve and a jacket segment being fastened to the fitting.

12. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including a surface that one of directly and indirectly engages a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element:

is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and is a slotted snap ring that is placed in the fitting and that surrounds the fuel injection valve.

13. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein the connecting element:

is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and is made up of two annular elements that surround the fuel injection valve and the fitting, the annular elements being secured by a clamp ring that surrounds them.

14. The fuel injection device according to claim 1, wherein the connecting element corresponds to a spring ring that is inserted on the fitting.

15. The fuel injection device according to claim 1, wherein the connecting element corresponds to a wire ring that is inserted on the fuel injection valve.

16. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein:

the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and an outer threading is provided on the fitting, onto which at least one of (a) a securing nut and (b) the connecting element itself is capable of being screwed.

17. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein:

the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and the connection of the connecting element to the fitting is at least one of (a) a force-locking connection, (b) a form-locking connection and (c) an integral connection.

18. The fuel injection device according to claim 1, wherein the fuel distributor line is fastened to the cylinder head by at least one connecting device.

19. The fuel injection device according to claim 18, wherein at least one damping disk is provided in an area of each connecting device.

20. The fuel injection device according to claim 19, wherein the damping disks are situated at least one of (a) with a seating directly on the fuel distributor line and (b) with a seating directly on the cylinder head.

21. The fuel injection device according to claim 1, wherein a hold-down device is clamped between a shoulder of the fuel injection valve and an end surface of the fitting.

22. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein:

the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and a hold-down device, that has a partially annular base element from which an axially flexible hold-down clip extends in bent-off fashion, is clamped between a shoulder of the fuel injection valve and an end surface of the fitting.

23. The fuel injection device according to claim 22, wherein the hold-down clip abuts the end surface of the fitting.

24. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein:

the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and a hold-down device, fashioned as a stamped bent part, is clamped between a shoulder of the fuel injection valve and an end surface of the fitting.

25. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein:

the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve; and a hold-down device:

is clamped between a shoulder of the fuel injection valve and an end surface of the fitting; and has, seen in a peripheral direction, an open area through which there extends a connecting plug of the fuel injection valve, the plug also extending through an opening of the connecting element.

26. A fuel injection device for a fuel injection system in an internal combustion engine, comprising:

at least one fuel injection valve;

a receptacle bore for the fuel injection valve in a cylinder head;

a fuel distributor line having a fitting in which an inlet end of the fuel injection valve is arranged in partially overlapping fashion; and a connecting element including at least one of (a) a holding collar and (b) a plurality of holding collar segments that one of directly and indirectly engage a surface of one of a shoulder and a flange of the at least one fuel injection valve, the surface being non-parallel to a longitudinal axis of the fuel injection valve that extends between the inlet end and an outlet end of the fuel injection valve, the engagement applying a force to the one of the shoulder and the flange in a first direction towards the inlet end of the fuel injection valve, wherein:

the connecting element is arranged such that the fuel injection valve and the connecting element do not directly contact, and do not indirectly contact via contact through one or more other elements, any surfaces or walls of the receptacle bore of the cylinder head that do not extend axially parallel to the fuel injection valve;

the at least one of (a) the holding collar and (b) the plurality of holding collar segments grasp the fuel injection valve; and a support ring is placed between the at least one of (a) the holding collar and (b) the holding collar segments of the connecting element and the one of the shoulder and the flange.

27. The fuel injection device according to claim 26, wherein the support ring is constructed so as be rounded towards the housing shoulder, and wherein the housing shoulder on the fuel injection valve includes a conical shape.

28. The fuel injection device according to claim 1, further comprising:

a biasing element that applies a force to the fitting in the first direction and applies a force to the fuel injection valve in a second direction opposite the first direction.

29. The fuel injection device according to claim 28, wherein the biasing element is a spring that extends between one of a shoulder and a flange of the fitting and one of a shoulder and a flange of the fuel injection valve.

30. The fuel injection device according to claim 28, wherein the biasing element is a clip having ends bent away from each other.

31. The fuel injection device according to claim 1, wherein the fitting includes an arch for connection of the connecting element to the fitting, a slope of the arch corresponding to a circle whose center is at a longitudinal axis of the fuel injection valve, the fuel injection valve being tiltable with respect to the fitting.

32. The fuel injection device according to claim 31, further comprising:

a sealing ring that seals between the fitting and the fuel injection valve, the center of the circle being situated in the center of the sealing ring.

33. The fuel injection device according to claim 1, wherein the one of the shoulder and the flange of the at least one fuel injection valve has one of a rounded and a conically shaped surface that engages a rounded surface.

* * * * *